United States Patent [19]

Waring

[11] Patent Number: 4,940,035

[45] Date of Patent: Jul. 10, 1990

[54] VARIABLE FLOW RATE PUMP FOR FLUID

[75] Inventor: Peter Waring, Wainuiomata, New Zealand

[73] Assignee: Her Majesty the Queen in right of New Zealand, New Zealand

[21] Appl. No.: 269,243

[22] Filed: Nov. 9, 1988

[30] Foreign Application Priority Data

Nov. 10, 1987 [NZ] New Zealand ..... 222499

[51] Int. Cl.[5] ..... F02M 39/00; F04B 1/28

[52] U.S. Cl. ..... 123/497; 123/496; 417/215; 417/486

[58] Field of Search ..... 123/497, 499, 498, 496, 123/357–359; 417/215, 486

[56] References Cited

U.S. PATENT DOCUMENTS

| | | | |
|---|---|---|---|
| 1,503,634 | 8/1924 | Bucherer | 417/215 |
| 3,029,743 | 4/1962 | Johns | 417/486 |
| 3,165,068 | 1/1965 | Burnham | 417/215 |
| 4,537,562 | 8/1985 | Lindmark | 417/215 |
| 4,714,066 | 12/1987 | Jordan | 123/496 |

FOREIGN PATENT DOCUMENTS

| | | | |
|---|---|---|---|
| 81306000.1 | 12/1981 | European Pat. Off. . | |
| 86200968.5 | 6/1986 | European Pat. Off. . | |
| 87200134.2 | 1/1987 | European Pat. Off. . | |
| 835401 | 3/1952 | Fed. Rep. of Germany | 417/215 |
| 2356335 | 5/1975 | Fed. Rep. of Germany . | |
| 2404810 | 8/1975 | Fed. Rep. of Germany . | |
| 1160421 | 7/1958 | France | 417/486 |
| 2452607 | 3/1979 | France . | |
| 2452608 | 3/1980 | France . | |
| 58-210357 | 12/1983 | Japan . | |

*Primary Examiner*—Carl Stuart Miller

[57] ABSTRACT

The pump of the invention has application as a fuel pump for delivering fuel over a range of flow rates to an internal combustion engine. The pump may however be employed in many other applications, such as chemical applications, medical applications and hydraulic applications for example, particularyly where fine control of the fluid flow rate and a fast response from the pump to flow rate change requirements is necessary.

13 Claims, 8 Drawing Sheets

VARIABLE FLOW RATE PUMP FOR FLUID

Figure 1:
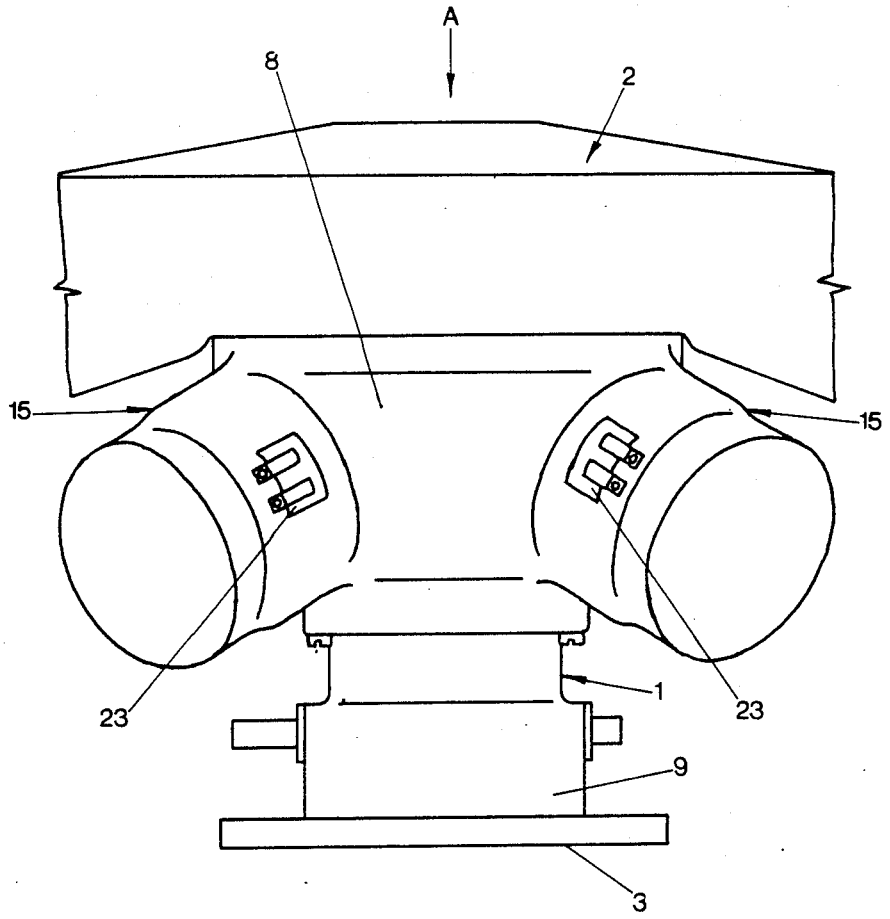

The invention comprises a pump for delivering fluid over a range of flow rates.

A major application of the pump of the invention is as a fuel pump for an engine. The most common means for introducing fuel to an Otto cycle or other type of spark ignition engine is a carburettor. In the carburettor fuel is drawn through a calibrated orifice, known as a jet, by the depression created in a venturi through which air passes in the induction system of the engine. An alternative to carburetion systems is various types of fuel injection systems where fuel is metered by mechanical or electro-mechanical means. Such injection systems usually comprise a means of determining the air flow into the engine, a high pressure fuel pump, a control system, and an injection nozzle or nozzles. A typical electro-mechanical system employs a nozzle or nozzles which incorporate solenoid-actuated valves, and fuel is supplied under a constant pressure to these nozzles and the nozzle valves are timed to open for an appropriate period during each revolution of the engine. Such nozzles with solenoid actuated valves or the like require high precision in their manufacture. In an alternative fuel injection system a nozzle or nozzles which when supplied with fuel under pressure deliver fuel continuously are employed, with the metering of the fuel to the engine being controlled by varying the pressure of the fuel at the nozzle. Various arrangements for controlling such an injection system and the pressure at which fuel is supplied to the injection nozzles in relation to the engine requirements are known.

Typical fuel injection systems are usually more expensive than carburetion systems, but are desirable to meet modern requirements for fuel economy and the reduced emission of noxious substances in exhaust gases. To meet performance requirements, it is necessary for the injection system to have the capacity to deliver closely regulated amounts of fuel over a range of flows of around 40:1, when using petrol. The wide range of the flow requirements is necessary because of the way in which the fuel demand of a typical engine varies between idling under no load and delivering maximum power at high engine speed. In addition, the rate of response of the system to changes in engine operating conditions should ideally be instantaneous.

It is an object of the present invention to provide an improved or at least alternative pump suitable for delivering fluid over a range of flow rates and having a relatively fast response from the pump to changes in flow rate requirements.

In broad terms the invention may be said to comprise a variable flow rate pump for fluid, comprising multiple electrically driven fluid delivery means communicating to a common fluid outflow from the pump wherein the rate of fluid delivery of the pump is variable by varying the phase of operation of said fuel delivery means relative to one another.

The relative phase of operation of the fluid delivery means may be variable between the fluid delivery means operating in unison with one another or towards in unison with one another, for delivery of fluid at a maximum rate, and the fluid delivery means operating in opposition to one another or towards in opposition to one another, for delivery of fluid at a minimum rate.

The electrically driven multiple fluid delivery means may comprise at least two pistons reciprocally movable independently of one another in fluid flow connected cylinders which are fluid flow connected with the pump outflow, and electromagnetic driving means associated with each piston. The frequency of alternating electric driving currents to each electromagnetic driving means is similar. The pistons will be caused to move in one direction and then, on the reversal of the current polarity, in the opposite direction. The phase of operation of pistons within their cylinders relative to one another is variable by varying the phase relationship between the driving signals to each electromagnetic driving means.

In the preferred forms of pump of the invention with the connection of the electromagnetic driving means to the driving currents as will be described, when the electric driving currents are 180° out of phase fluid is delivered by the pump at a maximum rate, whilst when the electric driving currents are in phase, the output of the pump is minimal. When the phase difference is at some intermediate angle the pump output will be at an intermediate level.

In terms of performance, the pump of the invention may be configured to deliver fluid over a relatively wide range of flow rates and the rate of fluid delivery can be regulated to close limits and varied from one flow condition to another over any part of the flow range with a relatively fast response time. The pump of the invention may be manufactured more economically than many other types of variable delivery pumps.

The pump of the invention is particularly suitable for use as an improved or at least alternative form of fuel pump for a fuel injection system for an internal combustion engine. The pump is particularly suitable as a fuel injection pump for a flexible fuel vehicle. Methanol has about half the energy content of petrol on a volumetric basis, and if an engine is intended to operate on both petrol and methanol between the limits of idling on petrol and operating at full power on methanol, the 40:1 flow range required just for petrol operation is approximately doubled, to approach 80:1. Intermediate flows will depend on the power requirements and the particular proportions of petrol and methanol on which the engine may be operating at any time.

The pump of the invention may be employed as a fuel injection pump as stated, but may also be employed in any other application where accurate delivery of metered quantities of a fluid over a range of flow rates with a relatively fast response is required. While the invention is generally described herein with reference to fuel delivery to an engine, it is not to be taken as limited thereto and the applicability of the pump of the invention in other areas will be apparent to those skilled in the art.

Figure 2:
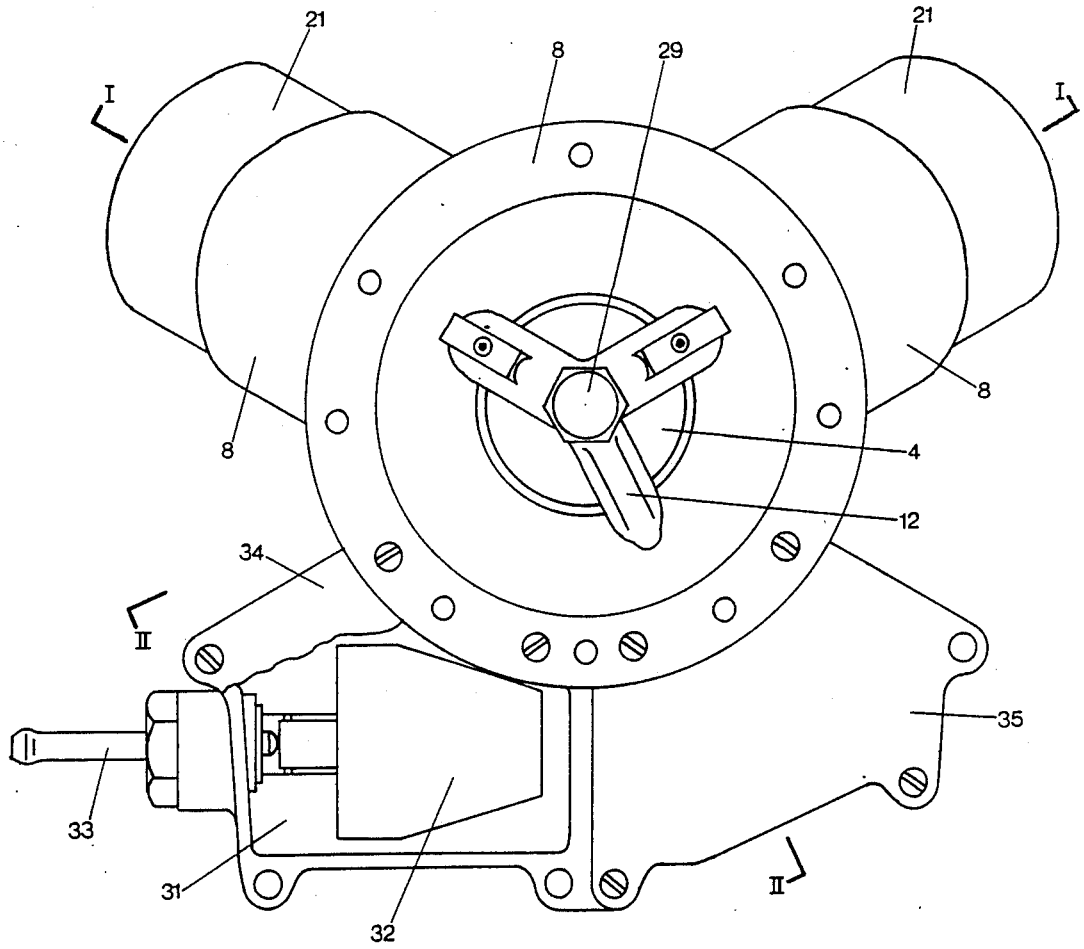
Figure 3:
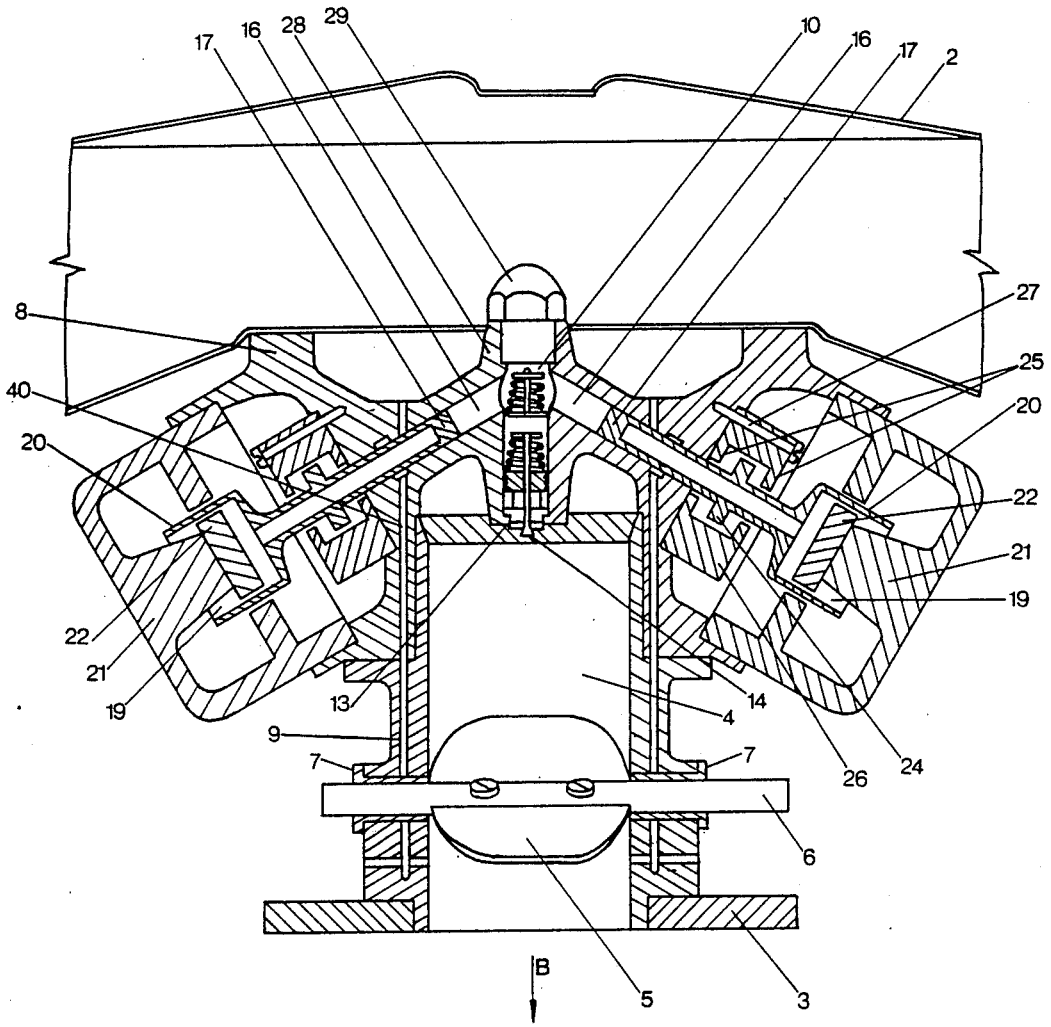
Figure 4:
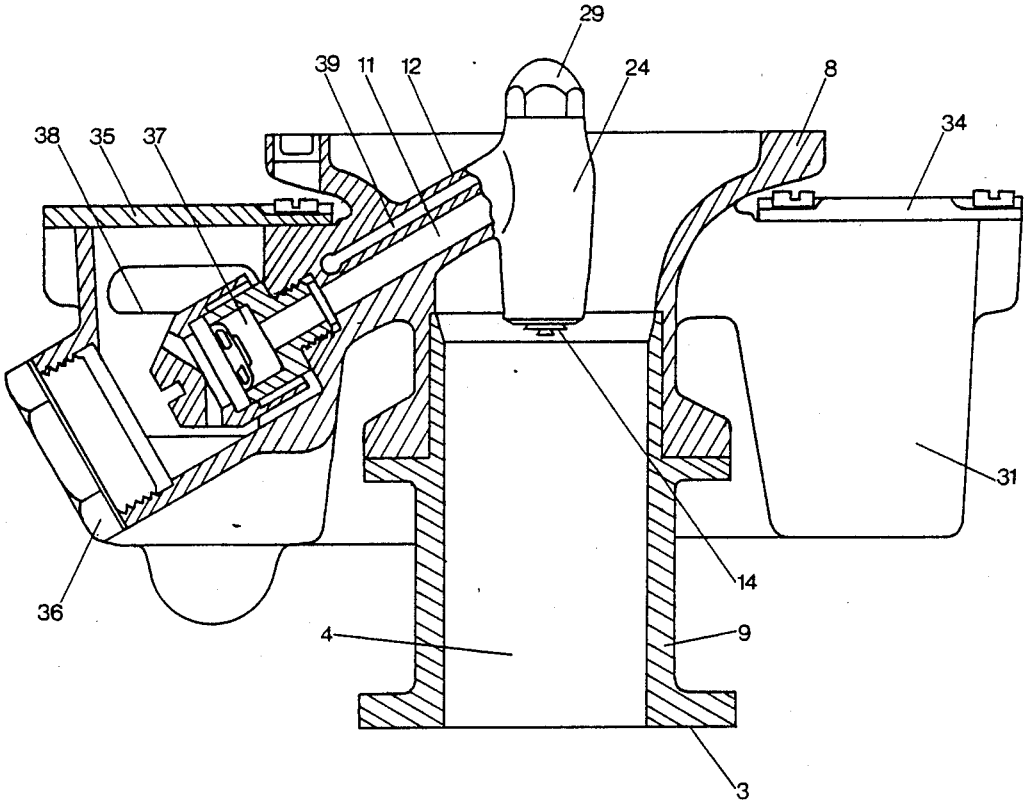
Figure 5:
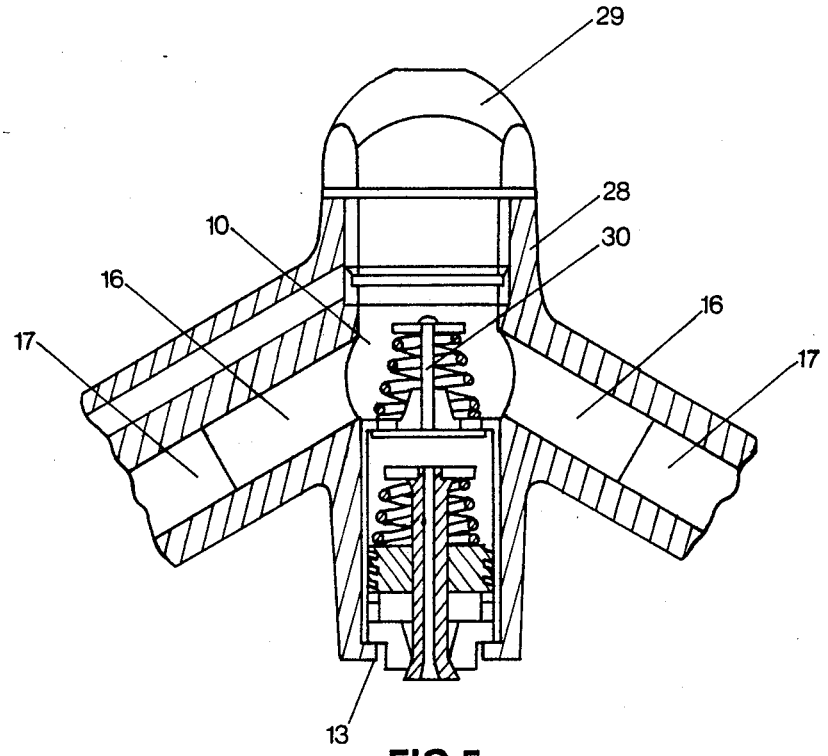
Figure 7:
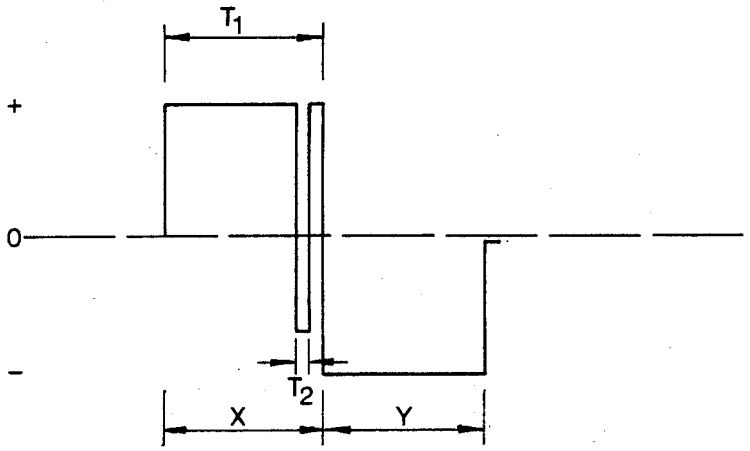
Figure 6:
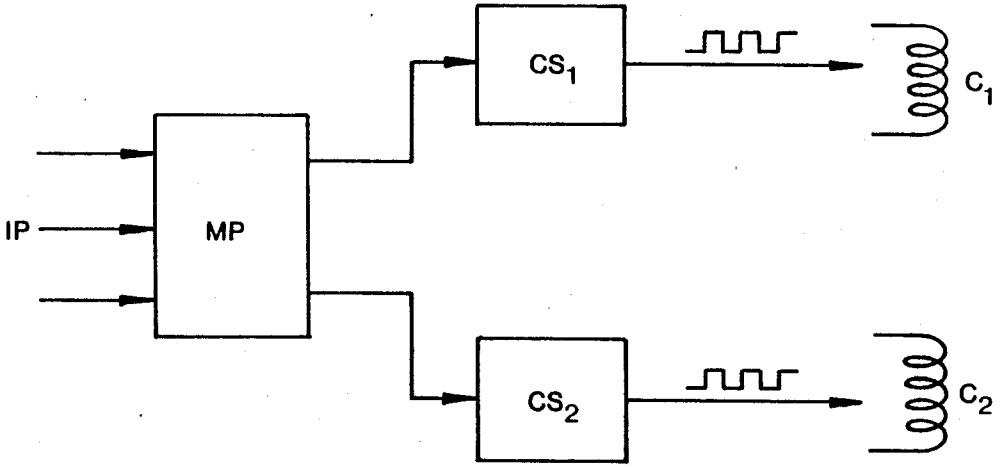
Figure 8:
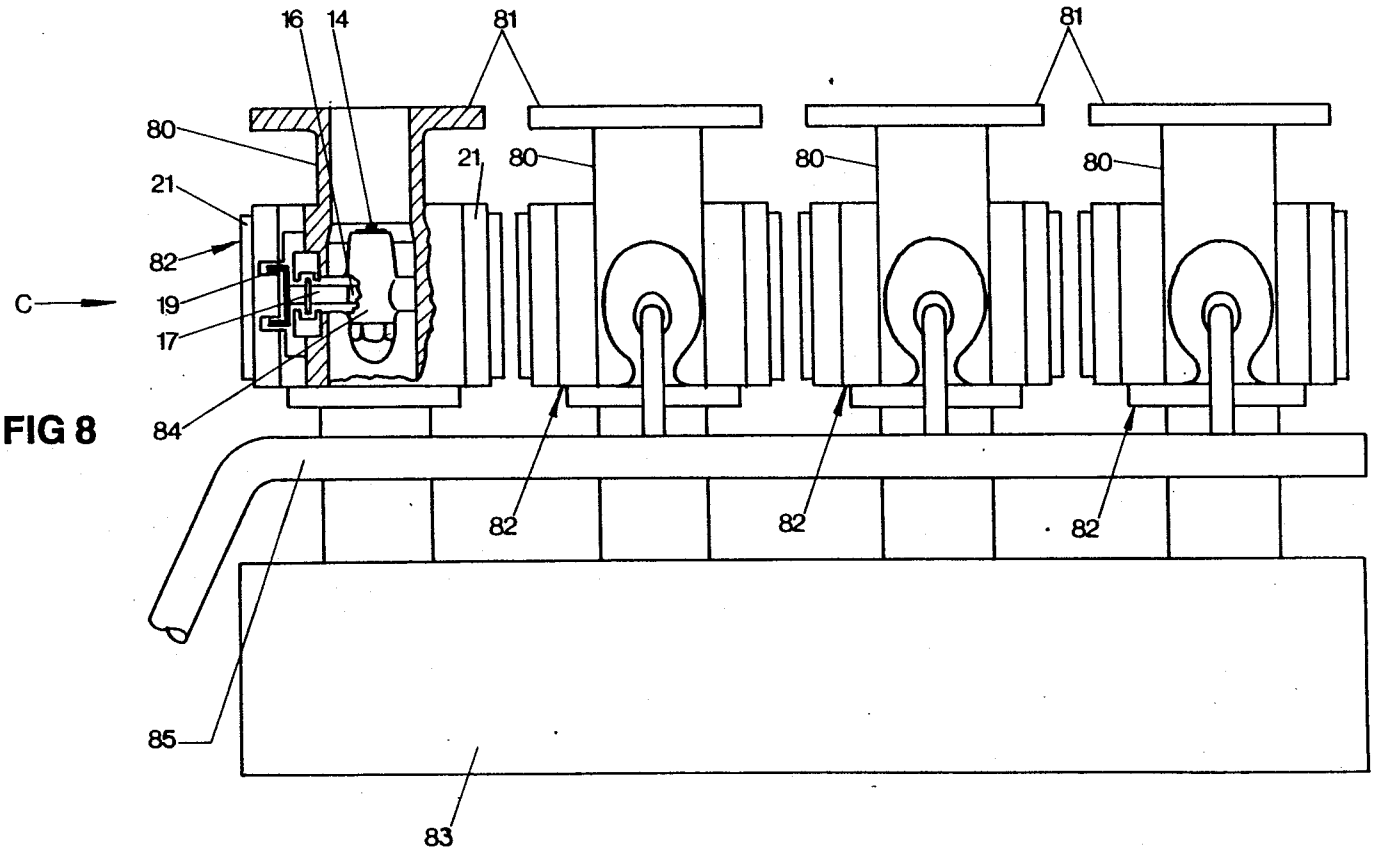
Figure 9:
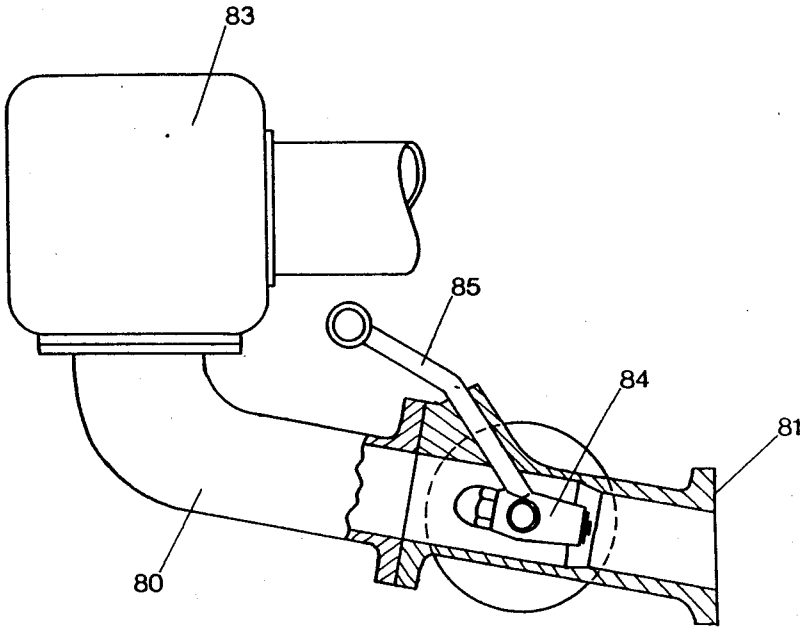

Two forms of pump of the invention, both configured as a fuel pump for an internal combustion engine such as an automobile engine are shown in the accompanying drawings, by way of example. In the drawings:

FIG. 1 is a view of a pump of the invention incorporated as part of a throttle body injection/induction system showing the throttle body and pump from one side additionally showing in part an air filter for the induction system, FIG. 2 is a view from above, in the direction of arrow A in FIG. 1, of the throttle body and pump of FIG. 1 with the air filter removed, FIG. 3 is a sectional view of the throttle body and pump along line I—I of FIG. 2, FIG. 4 is a sectional view of the throttle body and pump along line II—II of FIG. 2, FIG. 5 is a cross-sectional view similar to that of FIG. 3 of a part of the pump, FIG. 6 is a block diagram representation of an electrical driving system for the form of pump of the invention described, and FIG. 7 is an electric pulse diagram, FIG. 8 is a schematic partly cutaway view of a multi point fuel injection system for an automobile engine, incorporating pumps of the invention, and FIG. 9 is a schematic partly cut away view of the system of FIG. 8 in the direction of arrow C in FIG. 8.

The first form of pump of the invention shown in FIGS. 1 to 5 is incorporated in a throttle body for an internal combustion engine which is intended to be coupled to the intake manifold of the engine, to form a throttle body fuel injection system.

In the drawings the throttle body is generally indicated at reference numeral 1. A filter for intake air to the engine of a conventional form is indicated at 2, and the end of the throttle body intended to be coupled to the engine intake manifold is indicated at 3.

The throttle body 1 comprises a central passage 4 through which induction air passes during running of the engine in the direction of arrow B in FIG. 3, and a throttle plate 5. The throttle body 1 comprises two parts; an upper part 8 which will be referred to as the pump housing, and a lower part 9 which will be referred to as the throttle plate housing. The throttle plate 5 is, in the throttle body injection system shown, of a conventional form, and is carried by a spindle 6 in bushes 7 in the throttle plate housing 9. The throttle plate is suitably connected to the accelerator or other engine speed control system for the engine.

A cylindrical chamber 10 within the pump housing 8 forms an internal volume therein. Fuel may enter the chamber 10 through an inlet port 11 extending through a part 12 of the pump housing (see FIGS. 2 and 4), from a fuel supply via one way valving, as will be described. The chamber 10 comprises an outflow port 13 for the pump, which communicates the chamber with a spray jet 14, via one way valving as will be described.

Electromagnetically operated fuel delivery means, generally indicated at 15 in FIG. 1, in the form of pump of the invention described comprises two pistons reciprocally movable independently of one another in cylinders which are fluid flow connected, and fluid flow connected with the pump outflow. In the throttle body arrangement shown, there are two piston/cylinder fuel delivery mechanisms and the cylinders are formed within the pump housing 8 and are indicated at 16, and the pistons are indicated at 17. The piston/cylinder fuel delivery mechanisms work into the chamber 10. The two pistons 17 are independent of one another in that they are not connected by any mechanical link. The pistons should be constructed of some material unaffected by various fuels, such as polyacetal resin or aluminum alloy plated with corrosion resistant material such as nickel or chromium.

Each of the piston/cylinder fuel delivery mechanisms described has associated electromagnetic driving means for driving the pistons within their respective cylinders, to cause the pump to deliver fluid. In the form of pump shown, the piston skirts extend to emerge from the cylinders 16 at their ends opposite the chamber 10, and at the extending skirt of each piston 17 is provided a moving coil assembly.

A hollow, cylindrical former 19, preferably constructed from aluminum alloy or some other low density material of sufficient rigidity, is attached to or is integral with the end of each piston and a coil is wound on each former 19. Typically, the coils would comprise two layers of close windings of copper wire bonded to the coil formers 19 with suitable adhesive, and having an impedance of between 3 and 15 ohms at 1000 Hz, for example. The location of the coils on the formers 19 is indicated at 20 but the coils are finely wound and for clarity are not shown in the drawings. If the formers 19 are made from aluminum alloy or some other electrically conductive material they should be slit axially to prevent there being electrically-conductive paths around the circumferences of the formers. Each former 19 also is vented adjacent to its connection to its respective piston to allow air to pass from within the former cylinder through the former wall, to prevent correct operation of the pistons from being inhibited and to provide adequate heat dissipation from the upper coils (no venting shown in the drawings).

Generally cylindrical permanent magnets 21 threaded into complementary parts of the pump housing 8 on either side, as shown in the drawings, form the other part of the electromagnetic moving coil driving means. Each magnet 21 has an annular air gap 22 (similar to those used in electrical loudspeakers), and the coil formers 19 and coils are so dimensioned that they can reciprocate freely within the annular magnet gaps 22, through the full working strokes of the pistons 17. The moving coils are suitably connected to terminals 23 (see FIG. 1) for the supply of energising electrical currents to the moving coils, such as by small conductive springs, but any other suitable arrangement such as small conductive brush gear or the like could be employed. The electrical connection arrangement should impose the minimum restriction on the free movement of the coils and pistons.

With the arrangement of the invention and the electromagnetic driving means described, and when the coils are electrically energised with alternating currents of a similar phase and the same frequency, the pistons 17 will be caused to reciprocate with a similar phase of operation relative to one another, and fuel will be delivered from the pump outflow port 13, and the rate of delivery of fuel may be varied by varying the phase of operation of the piston delivery mechanisms relative to one another. The more similar the phase of operation of the two pistons the greater the flow rate of fluid from the pump, while if the piston/cylinder mechanisms are caused to operate with a less similar phase relationship the pump output will be decreased. Thus, the flow rate of fuel from the pump may be varied by varying the phase of operation of the piston/cylinder delivery mechanisms relative to one another. If the pistons are caused to operate in unison (i.e. the pistons move towards each other and then away from each other at the same time), the pump will deliver fuel at a maximum rate, while if the pistons are caused to reciprocate in opposition, the net delivery of fuel from the outlet will be a minimum. As the pistons are caused to operate with a phase relationship varying from in opposition to one another to in unison to one another, the delivery rate of fuel from the pump will be varied from a minimum to a maximum. The phase of operation of the two piston/-cylinder mechanisms may be controlled by controlling the relative phases of the same frequency, alternating polarity electrical driving currents to the moving coil driving means for each piston. In the preferred form arrangement described the coils are similarly wound and are so connected that if the driving current to one piston mechanism is in phase with the driving current to the other, the pistons will operate in opposition and the pump output will be a minimum as described, while if the electrical driving currents to each piston are 180° out of phase, the pistons will operate in unison and the pump output will approach its maximum. The flow rate of the pump may be varied with precision over a relatively wide range.

It is thus possible to vary the pump delivery rate at any instant by changing the phase relationship of the two alternating electrical currents supplied to the moving coil driving means. The response to a change in the phase relationship, to increase or decrease the pump delivery rate, can take place during the cyclic time of the alternating signals, and is relatively rapid; for example, if the signals supplied alternate at 50 Hz the pump will respond within one fiftieth of a second. This rate of response, for example, is sufficiently fast to enable the fuel demand of a typical internal combustion engine to be satisfied during any transient change in operation, since it will match the induction timing of a four-cycle engine operating at 6,000 rpm and thus cater for changes occurring between one camshaft revolution of engine at this speed and the next. If a faster response time is required, the frequency of the driving signals may be increased.

A control system for the preferred form pump is shown in FIG. 6 in block diagram form. Two electrical driving currents sources, one for each of coils $C_1$ and $C_2$, are indicated at $CS_1$ and $CS_2$. The driving current sources $CS_1$ and $CS_2$ generate similar frequency preferably square wave signals for energising the coils as referred to. The phase relationship between the signal sources $CS_1$ and $CS_2$ is controlled by a microprocessor MP to which inputs IP from for example an air mass flow sensor in the engine intake system, a throttle position sensor, and an engine rpm sensor, are provided. Any number of suitable inputs might be employed. The microprocessor determines the optimum fuel delivery rate and controls the phase relationship of the currents generated by the current sources $CS_1$ and $CS_2$ accordingly, for example by reference to suitable look up tables.

In the throttle body fuel injection system described, the control means may vary and control the phase relationship of the two driving current sources in such a way that the phase of the alternating currents may be in alignment or differ by any phase angle up to 180°. In response to the application of driving current from its respective alternating supply, each coil and its associated piston 17 will be caused to reciprocate, thus varying the effective combined volume of the cylinders 16 and connecting chamber 10. If the phases of the two driving currents to each coil are 180° out of phase, the pistons 17 will move in unison. In any cycle of operation, as the pistons 17 move towards each other fuel will be delivered from the outflow port 13 at the maximum rate, and as the two pistons move on their return stroke more fuel will be drawn into the chamber 10 and cylinders 16 for the next operation. If the phases of the driving currents are in phase relative to each other, the pistons 17 will move in opposition. As one piston moves inwardly toward the chamber 10 the other will be moving away from the chamber 10 on its outward stroke, and the minimum amount of fuel will be delivered by the pump. At any intermediate phase angle between the driving currents the pistons 17 will move such that fuel is delivered by the pump at an intermediate rate.

In the form of pump of the invention shown the limits of the working stroke of each of the pistons is defined by a collar 24, provided on an intermediate part of the piston skirt, working between stops 25. The stops 25 are preferably formed of a suitable resilient plastics material to prevent piston bounce at the ends of the piston stroke, which is more likely to occur if the stops 25 or any equivalent are formed of a rigid metal. The plastic stops have a degree of resilience or "give". The stops 25 are formed as inward annular projections from either end of an annular block 26 of the plastics material, which is located in position by screws 27 into the pump housing.

Valve means for the pump outflow is provided in the part 28 of the pump housing containing the chamber 10. This part 28 is located centrally over the throttle body bore 4 as shown in FIGS. 3 and 4, and is oriented such that the pump outlet port 13 and jet 14 face downwardly into the flow of induction air passing through the throttle body in use, so that the spray of fuel delivered from the jet 14 by the pump will evenly atomise into the intake air flow. As particularly shown in FIG. 5, an inspection and sealing cap 29 is threaded into the otherwise open opposite end of the pump housing part 28 to enable access to the interior between the pistons/-cylinders and to the outflow valving. The outflow valving within the part 28 comprises a first one way valve 30 which communicates the chamber 10 to a subsidiary chamber containing the spray jet 14. The outlet valve 30 and spray jet 14 are configured to open under pressure of fluid exiting the pump, but to close to prevent air from being drawn into the pump by the pistons on their return strokes. The spray jet 14 or other type of nozzle employed must be of a type which will produce a satisfactory spray pattern over the required flow range, such as 80:1 in the case of a dual fuel methanol:petrol engine; typically the flow rate will vary between 0.5 liters an hour and 65 liters an hour for engines between one and two liters capacity. It has been found that compound-pintle-type spray nozzles are satisfactory, with the primary nozzle being of fixed size and the secondary nozzle of variable aperture and spring-controlled to adjust to high rates of flow.

Referring to FIGS. 2 and 4, a float valve arrangement comprising a float bowl chamber 31 and float 32 supplies fuel to the pump over the inlet port 11 through a one way inlet valve 37. The inlet valve 37 is configured to allow fresh fuel to be drawn into the chamber 10 and cylinders 16 on the return strokes of the pistons, but to close to prevent fuel from being forced back into the float bowl chamber 31 on the delivery strokes of the pistons. The connection for supplying fuel to the float valve at a suitable low pressure is indicated at 33. The float bowl chamber 31 comprises dual float bowls with a weir between the two. Fuel must pass over this weir when moving from the first float bowl comprising its float to the second comprising the inlet valve, and the possibility of air entrainment in the fuel is minimised. In FIG. 2 the cover 34 of the first float bowl is shown partly cut away. A separate cover for second float bowl is shown at 35, and the inlet valve is also accessible via a threaded plug 36 (see FIG. 4). The weir through the wall between the two float bowls indicated at 38 in FIG. 4.

The fuel pump also incorporates a controlled bleed passage 39 (see FIG. 4) from the chamber 10 and outlet valve and spray jet back to the float bowl chamber 31, to enable fuel vapour to be removed from the chamber 10 and to prevent sonic choking of the injection nozzle by vapour produced by hot fuel. In addition, a counter bore 40 (see FIG. 3) communicates with each cylinder 16 midway along the pistons 17 and extends to a connection on the exterior of the pump housing (not shown) for connection to a vacuum source, so that any fuel leakage between the piston and cylinder is removed, and also so that any air leakage towards the piston from the magnet housings and coil assemblies is also scavenged away.

In other forms of pump of the invention other forms of fluid delivery mechanisms could be employed instead of piston/cylinder mechanisms, such as those described. An arrangement of electromagnetically driven moving diaphragms is one alternative. Generally two piston/-cylinder, diaphragm, or like fluid delivery mechanisms which may be controlled relative to one another will be sufficient to provide the range of flow rates and degree of metering control that might be required for any application, but it is possible within the invention for a greater number of mechanisms to be employed with the phase of operation of, say, three mechanisms being similarly controlled in relation to one another, to control the net output of the pump. For any particular pump, the maximum flow rate may be increased by increasing the bore and/or strokes of the pistons the diameter and stroke of the diaphragms, or the like. In the fuel pump described the flow rate is variable between nil, when the piston/cylinder delivery mechanisms operate in opposition, and the maximum, when the piston/cylinder delivery mechanisms operate in unison, but in another application where the same range of flow rates is not required the phase of operation between the respective fuel delivery mechanisms may be variable over a lesser range.

In the fuel injection pump described the two cylinder/piston mechanisms are arranged to operate at an upward angle into the chamber 10 in a V configuration, for air scavenging via the bleed passage 39, but any other configuration may be employed. The pistons may be arranged in a horizontally opposed configuration, or a vertical in line configuration, for example. In general the volume between the two piston/cylinder or other type of liquid delivery mechanisms, formed in the fuel pump described by the chamber 10, should be minimised. The fluid within this volume is reciprocated when the pistons operate in opposition and the inertia of the fluid in this volume should be minimised to minimise the required one way valve release pressures. The separation of the ends of the pistons should of course be arranged such that there is no risk of the pistons colliding at any point in their respective strokes, particularly when working in an in-line common co-axial cylinder.

In the fuel pump form of the invention described the electromagnetic drive means for the piston/cylinder mechanisms comprises a moving coil mechanism, with a fixed permanent magnet, but a moving magnet arrangement with a fixed coil is possible or the fixed and moving magnets may both comprise coil electromagnets. A further alternative electromagnetic driving means might comprise a moving armature connected to each piston with an associated arrangement of fixed coils or solenoids. Any means for electrically driving the pistons or other fuel delivery mechanisms is possible.

A multi point fuel injection system incorporating pumps of the invention is shown in plan in FIG. 8 and in side view in FIG. 9, schematically and partly cut away. In the multi point fuel injection system shown a pump of the invention and injection nozzle is provided individually to the intake port for each cylinder of the engine. The system shown in the drawings is intended for a four cylinder engine and the intake manifold comprises four intake ports 80. The intake ports 80 draw induction air from an air filter 83. Each intake port 80 comprises a flange 81 for coupling the port to the head of the engine. Each intake port 80 incorporates a pump unit of the invention, generally indicated at 82.

One pump unit is shown schematically cut away in both drawings. Generally in FIGS. 8 and 9 the reference numerals used for indicating components of the pump of the throttle body fuel injection system of FIGS. 1 to 5 indicate like components of the pumps of the multipoint injection system of FIGS. 8 and 9. Each pump unit comprises two horizontally opposed piston/-cylinder fuel delivery mechanisms, the pistons of which are indicated at 17, which work into a chamber within a part 84 of the pump similar to the part 28 housing the chamber 10 of the pump of the throttle body injection system. Each part 84 is mounted centrally within its respective intake port 80 and comprises a spray jet indicated at 14. A fuel supply manifold with branches for the supply of fuel to each individual pump unit is indicated at 85.

The control unit for the multi point fuel injection system shown would be similar to that for the throttle body system in terms of converting the inputs of various sensors into a phase angle between the alternating current supply units, the phase angle being appropriate to the fuel demands of the engine. The same driving current could be supplied to each pump unit so that the four pump units 82 are driven to operate together, or alternatively the control unit could supply a unique driving signal to operate each pump unit 82 individually, such that fuel is delivered into the respective intake port 80 in timing with the opening of the inlet valve(s) of the cylinder thereof.

The alternating driving currents provided to the moving coils or the equivalent of pumps of the invention are preferably square wave or substantially square wave signals. The cycle duration should be sufficient to ensure that the pistons or equivalent are driven fully from one end of their stroke to the other and that the pistons have zero motion, against the stops 25 in the fuel pump of FIGS. 1 to 5 described, at either end of their strokes. It is desirable that the pistons are held at the end of their strokes at least momentarily. The motion of the pistons may be electronically detected by optical, capacitive or magnetic means for example, through their strokes, with the signal shape of the driving currents being suitably modified to correct for undesired or non uniform movement of the pistons. The approach of the pistons to their physical stops could be so detected, and the possibility of piston rebound from the stops prevented by dampening the piston motion with a suitably timed short term reverse pulse of current, in the opposite direction to that driving the piston at that moment, being delivered to the moving coils or other electromagnetic driving means. There is no change in the overall timing of the driving waves; after the short term reverse current has finished the driving current restores to its original value and polarity, to hold the piston on its stop for the remainder of the wave form cycle. A pulse cycle of the driving current to one electromagnetic driving means including such a short term decelerating reversal is shown in FIG. 7. The period of the overall driving pulse for one stroke of the piston is indicated at $T_1$ and the period of the short term reversal at $T_2$. The piston moves in one direction during part X of the cycle and in the opposite direction during part Y.

The frequency of the driving currents provided to each piston/cylinder or equivalent arrangement should be the same, but where the pump is configured as a fuel injection pump it is possible for this frequency to be varied in synchronism with the engine rotation frequency, or in proportion to the engine rotation frequency, so that fuel delivery can be in phase with the opening sequence of the inlet valves of the engine.

As stated previously, the pump of the invention may be used for other applications where the fluid to be pumped is required to be delivered in amounts which may be varied at will, with rapidity and precision. Typical applications are in chemical dosing or sampling, the delivery of liquified chemicals in a processing stream, medical applications for delivering quantities of fluids such as medical treatment fluids, body fluids, or the like, hydraulic fluid to an actuator, nutrients into a hydroponic tank, to name a few. The pump of the invention is considered to have wide application.

The foregoing describes the invention including a preferred form thereof. Alterations and modifications will be obvious to those skilled in the art and are intended to be incorporated within the scope hereof, as defined in the following claims.

I claim:

1. An internal combustion engine fuel or fuel injection pump for delivering fuel to an engine over a range of fuel flow rates and engine operating condition, comprising:

at least two reciprocating fluid delivery mechanisms fluid flow connected to each other and to an outflow from the pump and able to operate at a frequency sufficient to enable the phase of operation of the fluid delivery mechanisms relative to one another to be varied in a response time enabling the flow rate of fuel from the pump to satisfy or substantially satisfy the changing fuel requirements of the engine as the engine speed or load varies;

electromagnetic means associated with each fluid delivery mechanism for driving same;

means for providing alternating electric energizing currents to each said electromagnetic means for driving the fluid delivery mechanism, in a manner enabling alteration of the phase relationship between said electric energizing currents for varying said phase of operation of the fluid delivery mechanisms relative to one another and thus the delivery rate of fuel from the pump, with said alternating electric energizing currents driving said fluid delivery mechanisms at said frequency sufficient to enable the operation of the fluid delivery mechanisms relative to one another and thus permitting the flow rate of fuel from the pump to be varied in a response time enabling the pump to satisfy or substantially satisfy the changing fuel requirements of the engine as the engine speed or load varies, over said range of engine operating condition.

2. An internal combustion engine fuel or fuel injection pump according to claim 1, wherein the phase of operation of said fluid delivery mechanisms relative to one another is variable between the fluid delivery mechanisms operating in unison with one another or towards in unison with one another, for delivery of fuel at a maximum rate, and the fuel delivery means operating in opposition to one another or towards in opposition to one another, for delivery of fuel at a minimum rate.

3. An internal combustion engine fuel or fuel injection pump according to claim 2, wherein the at least two fluid delivery mechanisms comprise at least two pistons reciprocally movable independently of one another in fluid flow connected cylinders fluid flow connected with the pump outflow.

4. An internal combustion engine fuel or fuel injection pump according to claim 2, wherein the at least two fluid delivery mechanisms comprise at least two moving diaphrams movable independently of one another in fluid flow connected chambers fluid flow connected with the pump outflow.

5. An internal combustion engine fuel or fuel injection pump according to claim 3, wherein the limits of movement of the pistons at either end of the stroke thereof are defined by physical stops formed of a material with sufficient a degree of resilience to minimize rebound of the pistons form said stops.

6. An internal combustion engine fuel or fuel injection pump according to claim 3, wherein the limits of movement of the pistons at either end of the strokes thereof are controlled by modification of the shape of the driving currents to the pistons as the pistons approach the end of the strokes thereof.

7. An internal combustion engine fuel or fuel injection pump according to claim 6, wherein said modification of the shape of the driving currents comprises a temporary decelerating reversal in the polarity of the driving currents towards the end of the piston strokes.

8. An internal combustion engine fuel or fuel injection pump according to any one of the claims 1 to 7, including control means for the pump comprising inputs from which the control means may determine the fuel requirement of the engine at any instant, and wherein the control means is arranged to alter the phase relationship between said energizing currents such that fuel is delivered to the engine at an optimum rate.

9. An internal combustion engine fuel or fuel injection pump according to claim 7, including control means for the pump comprising inputs from which the control means may determine the fuel requirement of the engine at any instant, and wherein the control means is arranged to alter the phase relationship between said energizing currents such that fuel is delivered to the engine at an optimum rate, and wherein motion of the pistons is sensed to provide an electronic indication of said motion to said control means for sue in generating said driving currents.

10. An internal combustion engine fuel or fuel injection pump according to claim 1, including control means for the pump comprising inputs from which the control means may determine the fuel requirement of the engine at any instant, and wherein the control means is arranged to alter the phase relationship between said energizing currents such that the fuel is delivered to the engine at an optimum rate, and wherein said control means is arranged to vary the cyclical speed of the pump by varying the frequency of said electrical driving currents in proportion to the speed of the engine.

11. An internal combustion engine fuel or fuel injection pump according to claim 3, wherein the pump is configured as part of a throttle body fuel injection system.

12. An internal combustion engine fuel or fuel injection pump according to claim 3, wherein one or more of the pumps are configured as part of a fuel injection system including spray nozzles delivery fuel in the intake port for each cylinder of the engine.

13. An internal combustion engine fuel or fuel injection pump for delivery fluid over a range of fuel flow rates and engine operating conditions, comprising:

a pump body having an internal volume;

at least two pistons reciprocally movable independently of one another in cylinders communicating with or forming part of said volume;

an inlet including one way valve means for the inflow of fluid to said volume and an outlet including one way valve means for the outflow of fluid;

moving coil electromagnetic driving means associated with each of the pistons, and control means for providing alternating polarity substantially square wave electric energizing currents to each of said electromagnetic driving means to cause the pistons to reciprocate at the frequency of said square wave energizing currents, said control means including inputs from which control means may determine the fuel requirement of the engine at any instant and being arranged to vary the phase of said square wave energizing currents relative to one another to cause the pistons to reciprocate from in unison with one another to in opposition to one another, or from towards in unison with one another to towards in opposition to one another, to continuously deliver fuel at an optimum rate to the engine.

* * * * *